US005606809A

United States Patent [19]

Allen

[11] Patent Number: 5,606,809

[45] Date of Patent: Mar. 4, 1997

[54] MECHANICAL EXCAVATORS

[75] Inventor: Walter R. Allen, Ashbourne, United Kingdom

[73] Assignee: J. C. Bamford Excavators Limited, Rocester, United Kingdom

[21] Appl. No.: 502,528

[22] Filed: Jul. 14, 1995

[30] Foreign Application Priority Data

Jul. 16, 1994 [GB] United Kingdom ..... 9414414
May 26, 1995 [GB] United Kingdom ..... 9510781

[51] Int. Cl.[6] ..... F02F 5/02

[52] U.S. Cl. ..... 37/443; 414/695

[58] Field of Search ..... 91/216, 217; 92/117, 92/196, 161; 37/442, 443; 172/47, 447, 474, 443, 444, 477, 272, 273, 274, 275, 667; 414/695, 695.5, 695.7, 694

[56] References Cited

U.S. PATENT DOCUMENTS

| | | | |
|---|---|---|---|
| 3,891,065 | 6/1975 | Iijima et al. | 419/695 X |
| 3,933,259 | 1/1976 | Irving | 414/695 |
| 3,993,206 | 11/1976 | Joman et al. | 414/695 |
| 4,020,745 | 5/1977 | Iijima et al. | 414/695 X |
| 4,104,954 | 8/1978 | Iijima et al. | 91/45 |
| 4,239,085 | 12/1980 | Venable et al. | 172/667 |
| 4,384,619 | 5/1983 | Schuck | 172/667 |
| 4,741,663 | 5/1988 | Kennedy | 414/695 X |
| 4,921,392 | 5/1990 | Wagner | 414/695 |
| 4,941,786 | 7/1990 | Steinbock | 172/667 X |

FOREIGN PATENT DOCUMENTS

| | | |
|---|---|---|
| 51118/73 | 7/1974 | Australia . |
| 1169734 | 1/1959 | France . |
| 949790 | 3/1964 | United Kingdom . |
| 1368255 | 9/1974 | United Kingdom . |
| 1483102 | 8/1977 | United Kingdom . |
| 1509239 | 5/1978 | United Kingdom . |

*Primary Examiner*—Eric K. Nicholson
*Assistant Examiner*—Robert Pezzuto
*Attorney, Agent, or Firm*—Marshall, O'Toole, Gerstein, Murray & Borun

[57] ABSTRACT

A mechanical excavator provided on a tractor or other vehicle and which comprises a main boom, which at its lower end is pivotally connected to a king post assembly for movement up and down in a vertical plane, a dipper arm pivotally connected to the outer end of the boom for movement in a vertical plane and carrying or being adapted to carry a bucket or like tool, the king post assembly providing for pivotal slewing movement of the main boom about a vertical axis so that the main boom can be rotated from one side to the other of the center line of the vehicle, the king post assembly being mounted upon a guide frame extending transversely of the center line of the vehicle, the king post assembly being moveable along the guide frame, and fixing clamps for releasably fixing the king post assembly relative to the guide frame, wherein a fluid operated ram connected between the king post assembly and an anchor which is adapted to be fixed relative to the guide frame whereby extension or contraction of the fluid operated ram causes movement of the king post assembly along the guide frame.

11 Claims, 7 Drawing Sheets

MECHANICAL EXCAVATORS

BACKGROUND TO THE INVENTION

This invention relates to a mechanical excavator herein referred to as "the kind specified", provided on a tractor or other vehicle and which comprises a main boom, which at its lower end is pivotally connected to a king post assembly for movement up and down in a vertical plane, a dipper arm pivotally connected to the outer end of the boom for movement in a vertical plane and the dipper arm carrying or being adapted to carry a bucket or like tool, the king post assembly providing for pivotal slewing movement of the main boom about a vertical axis so that the main boom can be rotated from one side to the other of the centre line of the vehicle, the king post assembly being mounted upon a guide means extending transversely of the centre line of the vehicle, the king post assembly being moveable along the guide means, and fixing means releasably to fix the king post assembly relative to the guide means.

Hitherto, when it has been desired to slide the king post assembly along the guide means, this has been done either by lowering the excavator bucket to engage the ground and then slewing the main boom about said vertical axis to cause movement of the king post assembly along the guide means to a desired position, or the main boom has been slewed until it is at 90° to the axis of the vehicle and the bucket then lowered to engage the ground, and the king post assembly being caused to move along the guide means by moving the dipper arm relative to the main boom (GB-959,790). Such methods of moving the king post assembly along the guide means are cumbersome and inconvenient.

An object of the present invention is to provide a mechanical excavator of the kind specified wherein the above mentioned problem is overcome or is reduced.

SUMMARY OF THE INVENTION

According to the present invention we provide a mechanical excavator of the kind specified wherein a fluid operated ram means is connected between the king post assembly and an anchor means which is adapted to be fixed relative to the guide means whereby extension or contraction of the fluid operated ram means causes movement of the king post assembly along the guide means.

In a first more specific aspect of the invention the fluid operated ram means is connected between the king post assembly and the anchor means so that said extension or contraction of the fluid operated ram means causes movement of an actuating part of the ram relative to the guide means and movement of the king post assembly relative to the guide means to the same extent.

The actuating part of the ram means may be connected to the king post assembly by means which prevent translational relative movement between the actuating part of the ram means and the king post assembly.

The anchor means may comprise a slider carried by a guide means which is capable of movement along the guide means and releasable fixing means being provided for fixing the slider at a desired position along the length of the guide means.

The fixing means of the slider may comprise fluid operated clamping means.

The stroke of the fluid operated ram may be smaller than the overall distance through which the king post assembly is moveable.

By virtue of providing an anchor means which is releasably fixable at a desired position along the guide means, the king post assembly can be disposed at any desired position longitudinally of the guide means by operating the ram means in a first direction with the anchor means fixed relative to the guide means to move the king post assembly in said first direction and then fixing the king post assembly relative to the guide means, releasing the anchor means and operating the ram means in the opposite sense to move the anchor means to a new position at which the anchor means is again fixed to the guide means and the king post assembly released therefrom, and then operating the ram means in the first direction again to move the king post assembly further in said first direction and so on.

By providing the ram means with an overall length which is not greater, or at least not substantially greater, than the overall length of the king post assembly, the king post assembly can be moved across the full width of the guide means since when the king post assembly is in one extreme position the ram means lies within, or substantially within, the longitudinal limits of the king post assembly.

The ram means may be provided to extend above or below the king post assembly and in substantially the same fore and aft region as that occupied by a bracket part of the king post assembly which is slidably supported by the guide means.

In a second more specific aspect of the invention the fluid operated ram means is connected between the king post assembly and the anchor means so that said extension or contraction of the fluid operated ram means causes movement of an actuating part of the ram means relative to the guide means and movement of the king post assembly relative to the guide means to a greater extent.

The actuating part of the ram means may be connected to the king post assembly by means which permit translational relative movement between the actuating part of the ram means and the king post assembly to provide said greater extent of movement of the king post assembly.

The fluid operated ram means may be connected to the king post assembly by a flexible element which extends between the king post assembly and an anchorage on the guide means, and the actuating part of the ram means being in engagement with the flexible element and being movable by said extension or contraction of the fluid operated ram means to cause said movement of the king post assembly along the guide means.

Preferably return means are provided to move the king post assembly in the opposite direction to that in which it is moved by said flexible element.

Preferably said return means comprises a second flexible element which extends between the king post assembly and an anchorage on the guide means and a second actuating part of the fluid operated ram means being in engagement with the second flexible element and being movable by said fluid operated ram means in the opposite direction to the first mentioned actuating part longitudinally of the guide means to move the king post assembly along the guide means in said opposite direction.

The fluid operated ram means may comprise a piston rod connected to said anchor means and a cylinder, said cylinder carrying the or each actuating part. Preferably a second piston rod extends from the cylinder at the opposite end thereof to said first mentioned piston rod, the second piston rod being connected to an anchor means which is adapted to be fixed relative to the guide means at the opposite end thereof to the first mentioned anchor means.

Preferably the cylinder carries said first and second actuating parts adjacent opposite ends thereof.

The or each actuating part may comprise at least one actuating member for engaging by a flexible element.

The actuating member may comprise a rotatable member.

The first and/or second flexible element may have a further flexible element disposed in spaced parallel relationship therewith to provide a pair of first and/or second flexible elements respectively and the ram means being provided with a pair or pairs of first and second actuating members.

The or each anchor means may be permanently fixed, or, at least during operation of the excavator may be fixed, relative to the guide means.

By connecting the fluid operated ram means to the king post assembly by a flexible element which extends between the king post assembly and an anchorage on the guide means with an actuating member, movable by the fluid operated ram means, being in engagement with the flexible element, it is possible to move the king post assembly to a greater extent longitudinally of the guide means than the actuating part of the ram means and hence it is possible to move the king post assembly longitudinally of the whole extent of the guide means with a fluid operated ram means having an extent of piston rod movement which is less than the longitudinal extent of the guide means.

Said anchorage may be provided at a position at or adjacent the middle of the longitudinal extent of the guide means.

The or each flexible element may comprise a pivoted link chain.

The ram means may be provided to extend longitudinally of the guide means at a position between the upper and lower limits of the king post assembly and in a region disposed in front of a bracket part of the king post assembly which is slidably supported by the guide means.

In both of said more specific aspects or in the broadest aspect of the invention, the guide means may comprise a frame comprising a plurality of elongated guide members arranged horizontally in vertically spaced relationship to extend at right-angles to the longitudinal axis of the vehicle and the king post assembly is carried by said guide members so as to be capable of sliding movement along the guide members with the releasable clamping means being provided for fixably clamping the king post assembly to the guide members.

Preferably the fixing means of the king post assembly comprise fluid operated clamping means.

BRIEF DESCRIPTION OF THE DRAWINGS

Two examples of the invention will now be described with reference to the accompanying drawings wherein.

DESCRIPTION OF THE PREFERRED EMBODIMENTS

Figure 1:
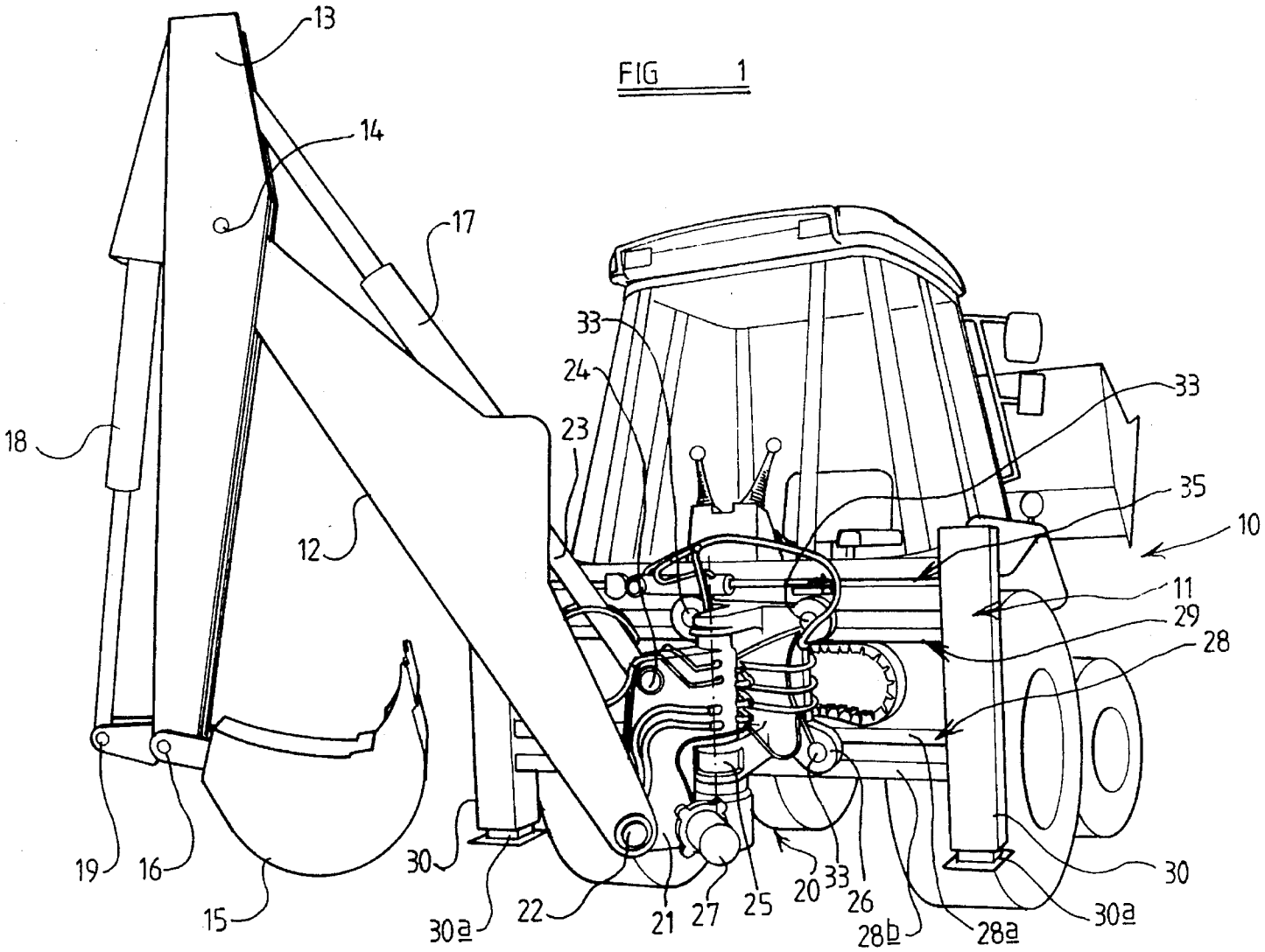
FIG. 1 is a perspective view of a mechanical excavator operating from the rear of a vehicle.
Figure 2:
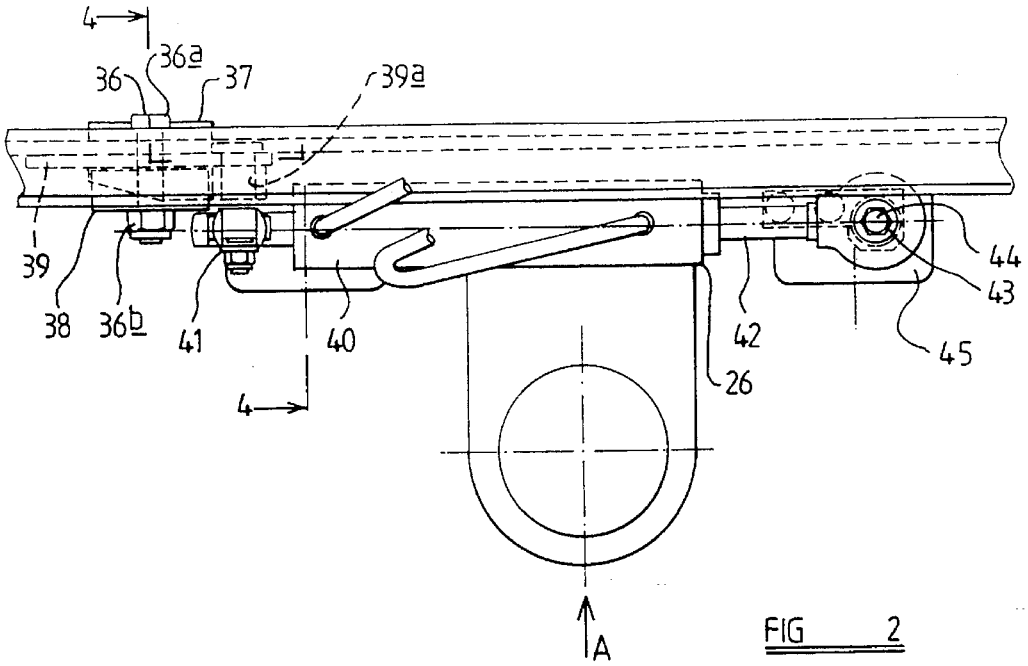
FIG. 2 is a fragmentary plan view of part of the mechanical excavator shown in FIG. 1 and drawn to an enlarged scale.

FIG. 1 shows a vehicle 10 having at the rear a sub-frame 11 which provides a guide means upon which a mechanical excavator is mounted. The excavator comprises a main boom 12 to which a dipper arm 13 is pivotally mounted, as shown at 14 and a bucket 15 is pivotally mounted to the dipper arm, as shown at 16. A hydraulic ram 17 is connected between the main boom 12 and the dipper arm 13 for causing pivotal movement therebetween, whilst a crowd ram 18 is pivotally connected between the dipper arm 13 and a crowd linkage 19 which is connected to the bucket 15 in conventional manner.

The dipper arm 12 is carried on a king post assembly 20 comprising a boom support 21 to which the main boom 12 is pivotally connected as shown at 22 and there being a hydraulic ram 23 pivotally connected between the main boom 12 and the support 21, as shown at 24 for causing pivotal movement of the main boom 12 up and down in a vertical plane.

The support 21 is connected by a king post 25 to a king post carriage 26 with a hydraulically powered rotary actuator 27 being provided for causing slewing movement of the main boom 12, about a vertical axis defined by the king post 25, relative to the carriage 26.

The carriage 26 is mounted upon the transverse frame 11 which is secured to, or may be an integral part of, the rear of the vehicle 10 so as to extend at right angles to the longitudinal centre line which runs fore and aft of the vehicle.

The frame 11 comprises two horizontal king post assembly guide members 28, 29 which extend between and are connected to two upright posts 30, which are conveniently made of box section with hydraulically operable telescopic legs 30*a* housed therein.

The guide members 28, 29 are each formed from two angle section girders suitably welded at their ends to connect them to the upright posts.

Figure 4:
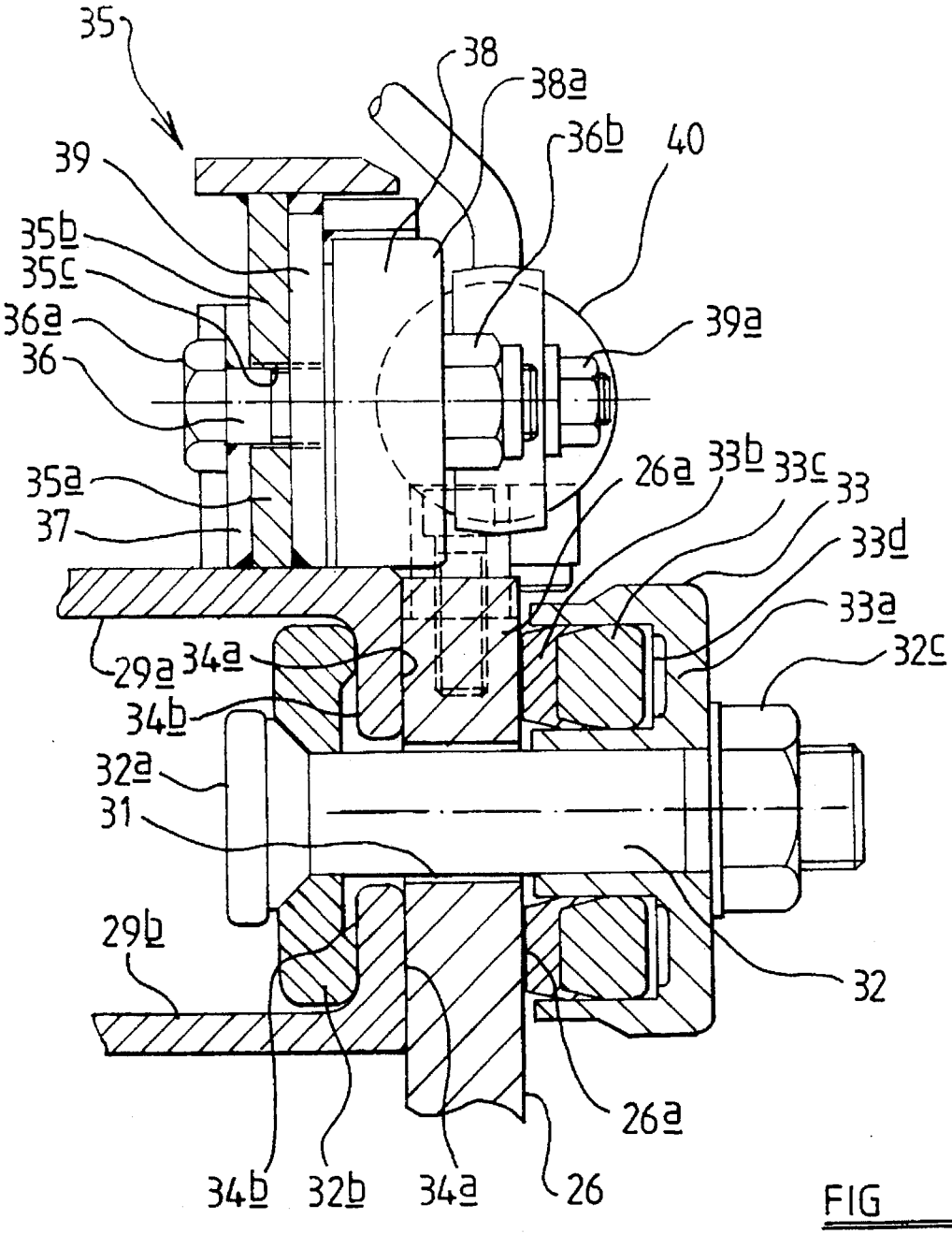
FIG. 4 is a section on the line 4—4 of FIG. 3.
Figure 5:
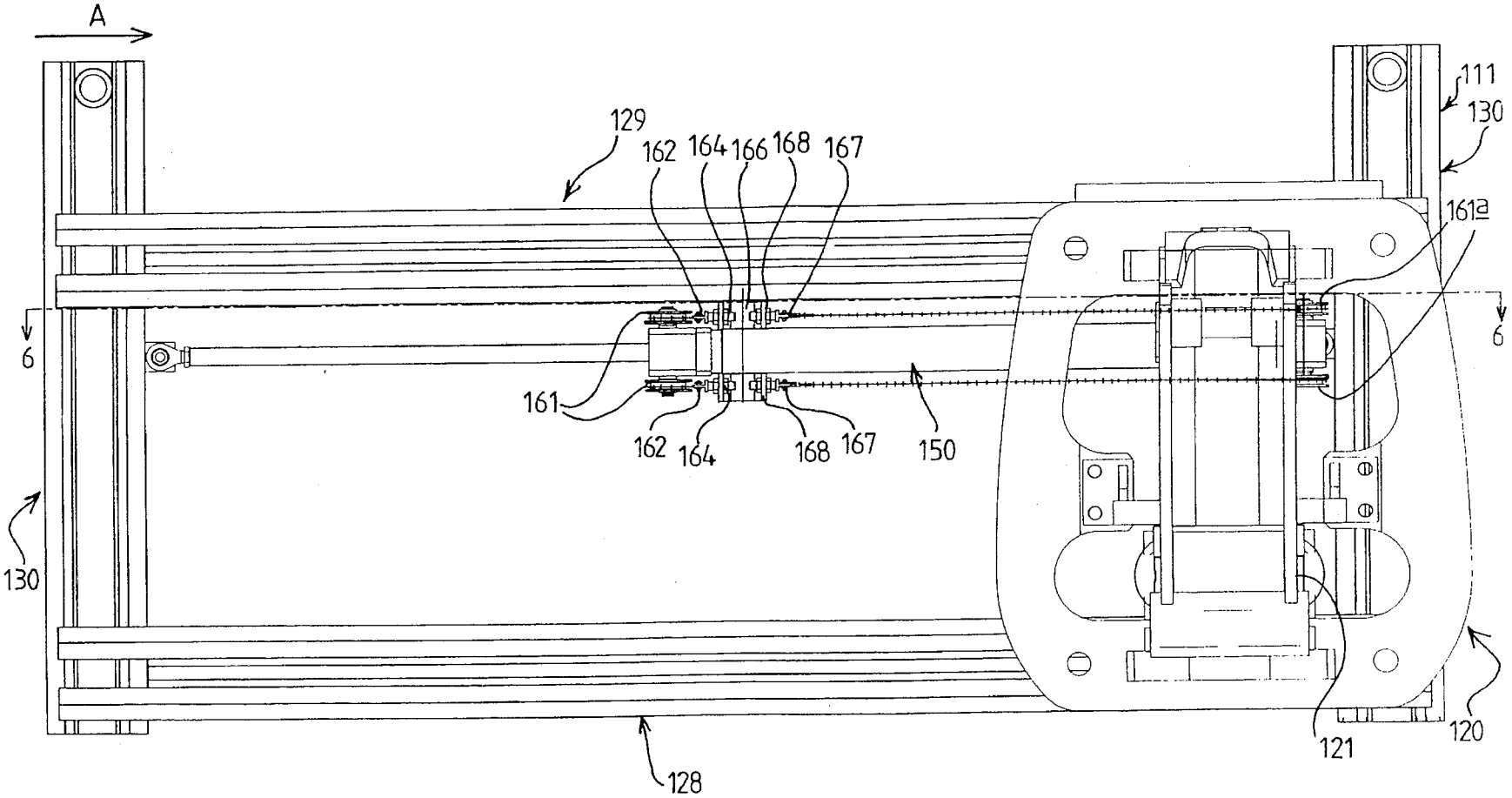
FIG. 5 is a fragmentary elevation of an alternative form of guide means embodying the invention for attachment to a mechanical excavator as described previously.
Figure 6:
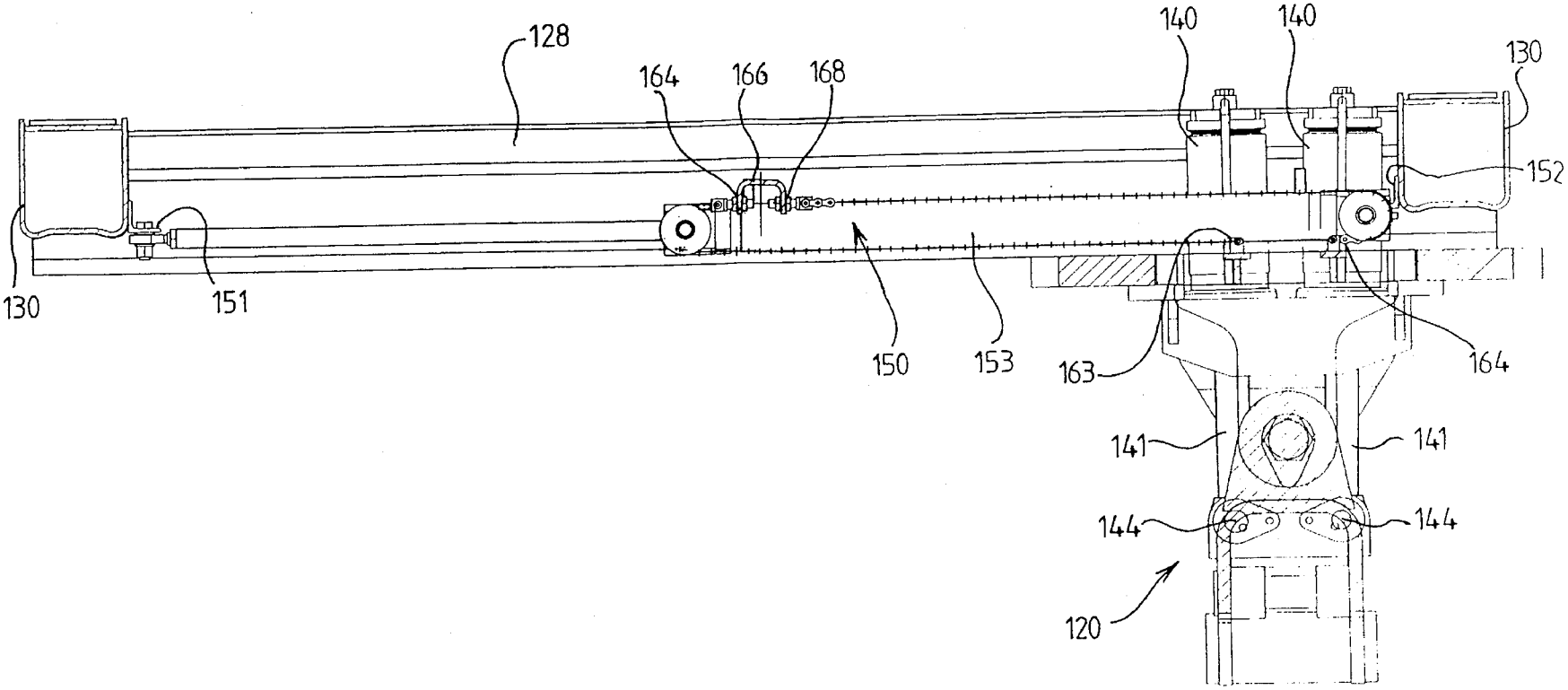
FIG. 6 is a section on the line 6—6 of FIG. 5.
Figure 7:
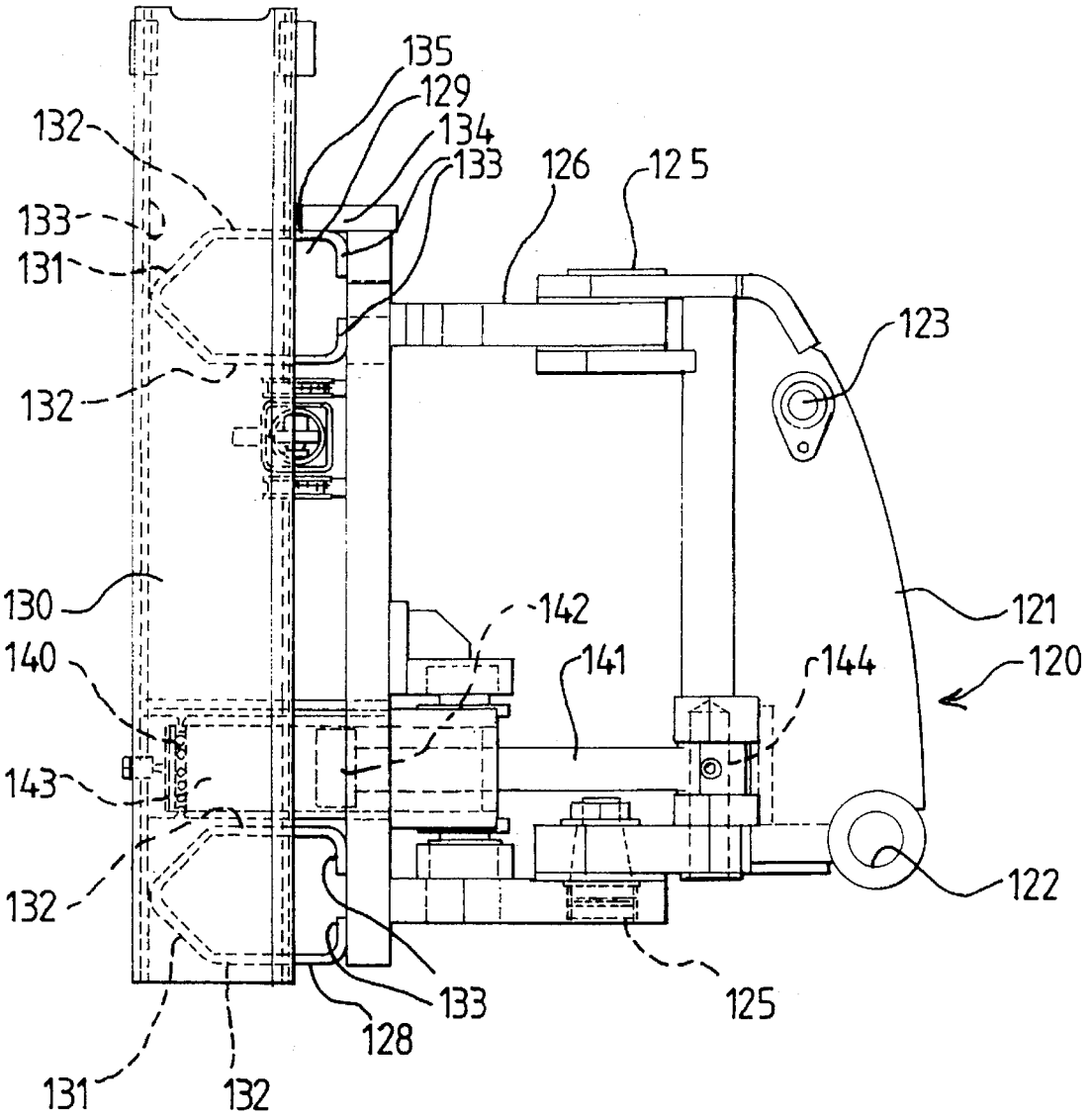
FIG. 7 is an end view looking in the direction of the arrow A in FIG. 5.
Figure 8:
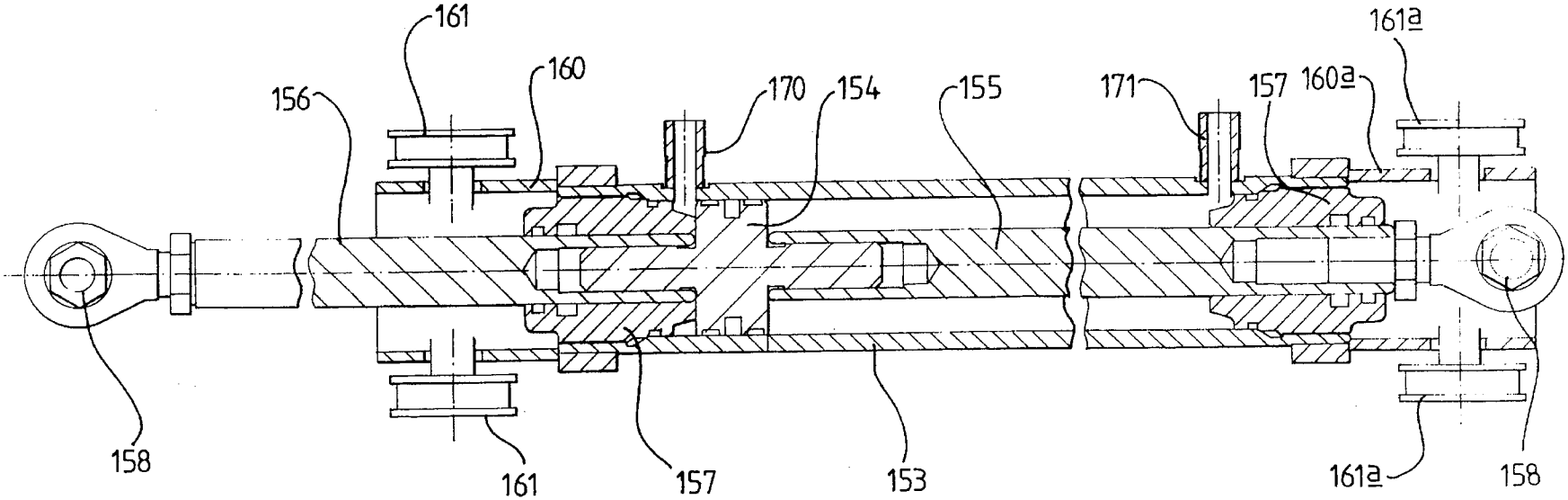
FIG. 8 is a fragmentary cross-section to an enlarged scale through a fluid operated ram of the arrangement shown in FIGS. 5 to 7.

Accordingly, the lower king post assembly guide member 28 comprises a pair of spaced angle section elements 28*a*, 28*b* whilst the upper king post assembly guide member 29 comprises a pair of spaced angle section elements 29*a*, 29*b* respectively, see FIG. 4. The king post carriage 26 has four apertures 31 through which clamping pins 32 extend. A head 32*a* of each pin engages a clamp plate 32*b* which slides in a channel provided by the angle section members 29*a*, 29*b*. The other end of the pin has a nut 32*c* threadedly engaged therewith to provide an abutment for a body 33*a* of a conventional hydraulic clamping means 33, a piston 33*b* of which engages a surface part 26*a* of the carriage 26. A rubber seal 33*c* is provided between the piston 33*b* and a chamber 33*d* to and from which hydraulic fluid is admitted through a port, not shown.

When unclamped, the weight of the carriage and the boom assembly carried thereon is carried on the pins 32 and transmitted to the members 29*a*, 29*b* through the clamp plates 32*b*. The hydraulic clamping means 33 which, when actuated, clamp the carriage 26 against the rearwardly facing surface 34*a* of the upper and lower guide members and the clamp plate 32*b* against the opposite face 34*b* of the guide members.

The frame 11 includes a further guide means 35 comprising a bar 35*a* welded to the guide element 29*a* to upstand therefrom and a T-section fabrication 35*b* welded at its ends to the posts 30.

A gap 35*c* is provided between the bar 35*a* and the stem of the fabrication 35*b* through which a clamping pin 36 extends. At one end the clamping pin 36 has a head 36*a* which engages a clamp plate 37 and at its other end the pin 36 is threadedly engaged with a nut 36*b* which provides an abutment for a body 38*a* of a conventional hydraulic clamp 38 of similar configuration to the clamps 33 described hereinbefore.

A slider plate 39 of an anchor means is slidable relative to the elements 35*a*. 35*b* and is adapted to be clamped thereto by the clamp 38.

The slider plate 39 carries a rearwardly extending pin 39*a* to which one end of a conventional hydraulic ram 40 is connected through a ball type joint 41. The ram 40 has a piston rod 42, one end of which provides an actuating part of the ram means which is connected through a further ball type joint 43 to a pin 44 mounted on a bracket 45 bolted or otherwise fixed to the bracket 26. This connection between the actuating part of the ram means and the king post assembly prevents translational relative movement therebetween so that movement of the actuating part of the ram means causes movement of the king post assembly therewith so that both move relative to the guide means to the same extent.

It will be noted that the overall length of the ram and piston rod 41, 42 in their retracted position is less than the overall length L of the king post carriage 26.

In use, when it is desired to adjust the position of the king post assembly the clamp 38 is operated to clamp the slider 39 to the guide means 35. The ram 40 is then operated to extend or contract, as appropriate, the piston rod 42 to adjust the position of the king post carriage, having previously released the clamping means 33 thereof.

If it is desired to move the king post assembly through a greater distance than the available stroke of the piston rod 42, then after the maximum available extent of movement has occurred, the clamps 33 of the king post carriage 26 are operated to clamp the king post carriage to the guide means and the clamp 38 of the anchor means 37 is released. The ram 40 is then operated to move the slider 37 in the desired direction whereupon the clamp 38 is energised and the clamps 33 de-energised and the ram 40 again operated to move the king post carriage 26 through a further increment of movement. This sequence of operation is repeated step by step as necessary so that the king post carriage 26 can be positioned at any desired position along the guide means.

Figure 3:
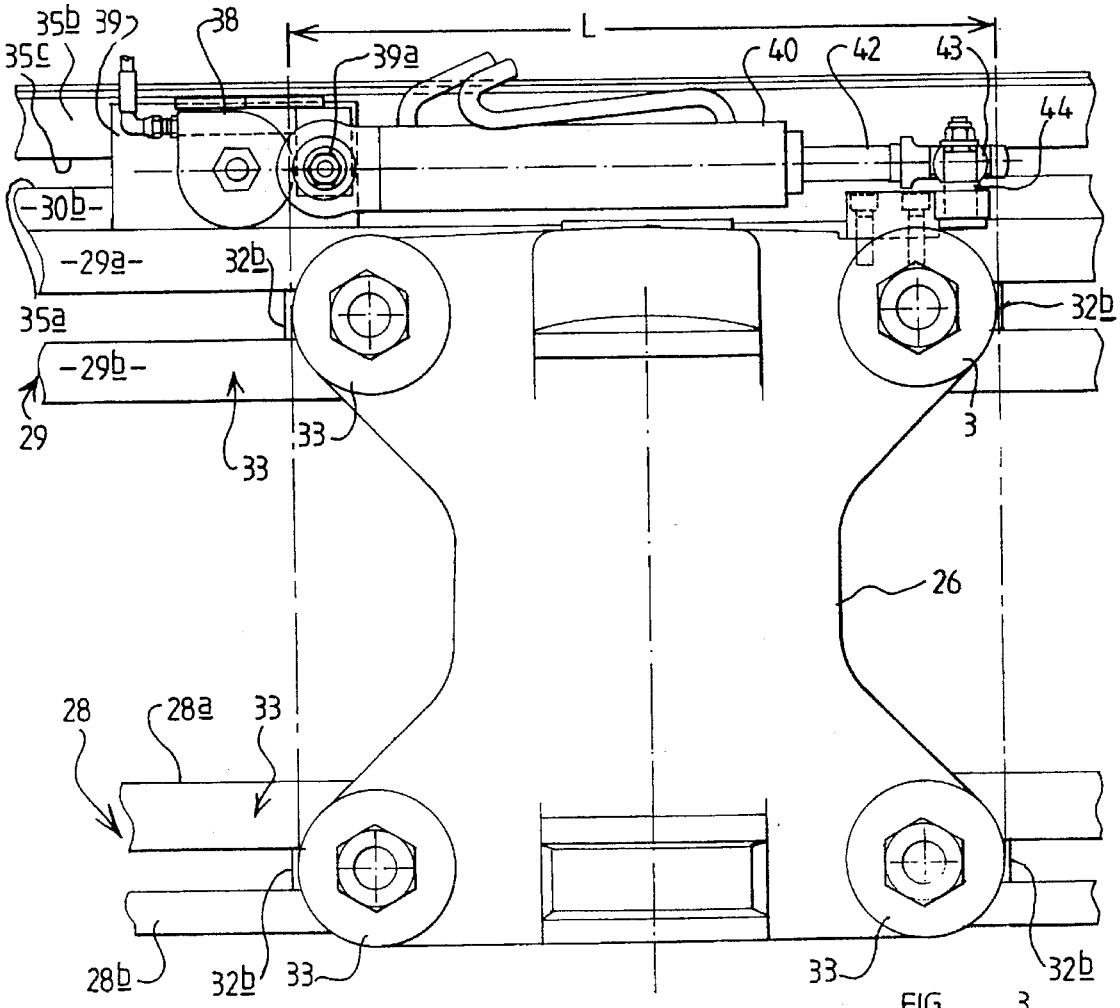
FIG. 3 is an elevation of the part of the excavator shown in FIG. 2 in the direction of the arrow A.

Because the ram and piston rod 40 and 42 are of lesser overall length than the length L of the carriage 26, then the ram and piston rod 40, 42 are accommodated in the region above the carriage 26 so that the carriage 26 can be moved fully to the left-hand side, as viewed in FIG. 3.

If desired the ram and piston rod 40, 42 may be disposed below the carriage 26.

Although hydraulic clamps have been described hereinbefore as the fixing means for the king post carriage and the anchor means, any other suitable releasable fixing means may be provided.

FIGS. 5 to 8 show a sub-frame arrangement of an alternative embodiment of the invention. In this embodiment the sub-frame is indicated generally at 111 and again provides a guide means on which a mechanical excavator is mounted. The mechanical excavator is as described in connection with the first embodiment and hence it is not described or illustrated again. A king post assembly is indicated generally at 120 and comprises a boom support 121 to which the main boom is pivotally connected by a pivotal connecting means 122 and there being a hydraulic ram pivotally connected between the main boom and the support 121 by a pivotal connecting means 123 causing pivotal movement of the main boom up and down a vertical plane.

The support 121 is connected by king post pivot pin means 125 to a king post carriage 126 for slewing movement of the main boom about a vertical axis defined by the king post pivot pin means 125 relative to the carriage 126.

The carriage 126 is mounted upon the transverse frame 111 which is secured to, or may be an integral part of, the rear of a vehicle similar to the vehicle 10 of the first embodiment so as to extend at right-angles to the longitudinal centre line which runs fore and aft of the vehicle.

The frame 111 comprises two horizontal king post assembly guide members 128, 129 which extend between and are connected to two upright posts 130, which are conveniently made so as to be of box section with hydraulically operable telescopic legs housed therein similar to legs 30 of the first embodiment.

The guide members 128, 129 each comprise a channel section girder having a "V"-section base 131 and spaced parallel limbs 132. At their free ends the limbs 132 have inturned flanges 133 which provide bearing surfaces for the carriage 126.

At its upper end the carriage 126 has an abutment plate 134 which rests on and is adapted to slide along an outer part 135 of the upper limb of the two limbs 132 of the guide member 129 so that the weight of the king post assembly and associated boom and dipper arm etc. is carried thereby.

The support 21 is slewed about the hereinbefore referred to vertical axis relative to the king post carriage 26 by means of a pair of hydraulic rams 140 each of which has a piston rod 141 which can be extended and retracted by feeding hydraulic fluid to opposite sides of a piston 142 fixed relative thereto within a cylinder 143 of the ram. Each piston rod 141 is connected at the outer end to the boom support 120 as shown at 144.

Clamping means, not shown, similar to the clamping means 33 of the first embodiment are provided with their clamping pins (32) extending through apertures 31 (which correspond to the apertures 31 of the first embodiment).

In order to adjust the king post carriage longitudinally of the guide means so that it may be disposed at any desired position transversely of the rear of the tractor, a fluid operated ram means 150 is connected between the king post assembly 120 and an anchor means comprising angle brackets 151, 152 adapted to be fixed by welding to the uprights 130 of the guide means. If desired the anchor means may be permanently fixed relative to the guide means or fixed relative to the guide means at least during operation of the excavator in any other suitable manner, for example by bolting or clamping.

The fluid operated ram means comprises a cylinder 153 in which a piston 154 is sealingly and slidably mounted in conventional manner. The piston 154 has a pair of opposed piston rods 155, 156 projecting therefrom and sealingly and slidably engaged with end caps 157 of the cylinder 153. The piston rods 155, 156 are connected through a rubber bushed joint 158 to an associated one of the brackets 151, 152.

The cylinder 153 has a tubular extension 160, 160*a* of square crosssection at each end and the tubular extensions carry a pair of opposed chain rollers 161, 161*a*. A first pair of pivoted link chains 162 extend between a position 163 on the king post assembly and an anchorage 164 provided on an anchor bracket 166 which depends downwardly from the guide means 129. The chain rollers 161 engage the chains 162 so that they are entrained partially around the surface of the roller 161.

A second pair of chains 167 extend from a second position 164 on the king post assembly 120 to an anchorage 168 provided on the anchor bracket 166 and are engaged by chain rollers 161*a* provided at the opposite end of the cylinder 153. The roller 161 and 161*a* thus provide actuating parts of the fluid pressure ram means 150.

In use, hydraulic fluid is fed to a desired side of the piston 154 through one of ports 170, 171 whilst fluid is withdrawn from the opposite side of the piston 154 through the other of the ports 170, 171. This causes extension of one of the piston rods 155, 156 and retraction of the other, with consequent driving of the king post assembly longitudinally of the guide means. It will be appreciated that the king post assembly moves twice the distance moved by the actuating means and thus the king post assembly can be moved along the complete length of the guide means with an extent of piston travel of the ram assembly equal to one half of the travel of the king post assembly. The clamping means 33' are released or engaged as necessary to permit of such adjustment.

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

We claim:

1. A mechanical excavator provided on a vehicle, the mechanical excavator comprising:

a main boom, said main boom being pivotally connected at its lower end to a king post assembly for movement up and down any vertical plane, a dipper arm pivotally connected to the outer end of the boom for movement in a vertical plane, the king post assembly providing for pivotal slewing movement of the main boom about a vertical axis so that the main boom can be rotated from one side to the other of a center line of the vehicle, the king post assembly being mounted upon a guide means extending transversely of the center line of the vehicle, the king post assembly being moveable along the guide means, fixing means for releasably fixing the king post assembly relative to the guide means, a fluid operated ram means connected between the king post assembly and an anchor means adapted to be fixed relative to the guide means whereby the extension and contraction of the fluid operated ram means causes movement of an actuating part of the ram relative to the guide means and movement of the king post assembly relative to the guide means to the same extent, the actuating part of the ram means being connected to the king post assembly by means which prevent translational relative movement between the actuating part, of the ram means and the king post assembly, the anchor means comprising a slider carried by the guide means and capable of movement along the guide means, and releasable fixing means for fixing the slider at a desired position along the length of the guide means.

2. An excavator according to claim 1 wherein the fixing means of the slider comprises fluid operated clamping means.

3. An excavator according to claim 1, wherein the stroke of the fluid operated ram is smaller than the overall distance through which the king post assembly is moveable.

4. An excavator according to claim 1 wherein the ram means has an overall length which is not greater than the overall length of the king post assembly, and wherein when the king post assembly is in one extreme position the ram means lies within the longitudinal limits of the king post assembly.

5. An excavator according to claim 4, wherein the ram means is provided to extend one of above and below the king post assembly and in a fore and aft region as occupied by a bracket part of the king post assembly which is slidably supported by the guide means.

6. A mechanical excavator provided on a vehicle, the mechanical excavator comprising:

a main boom, said main boom being pivotally connected at its lower end to a king post assembly for movement up and down in a vertical plane, a dipper arm pivotally connected to the outer end of the boom for movement in a vertical plane, the king post assembly providing for pivotal slewing movement of the main boom about a vertical axis so that the main boom can be rotated from one side to the other of a center line of the vehicle, the king post assembly being mounted upon a guide means extending transversely of the center line of the vehicle, the king post assembly being moveable along the guide means, fixing means for releasably fixing the king post assembly relative to the guide means, a fluid operated ram means connected between the king post assembly and an anchor means fixed relative to the guide means, the fluid operated ram means being connected between the king post assembly and the anchor means so that extension and contraction of the fluid operated ram means to a first extent causes movement of the king post assembly along the guide means to a greater extent than the first extent, the fluid operated ram means comprising a a piston rod means connected at one end to said anchor means and a cylinder means carrying first and second actuating parts at opposite ends of the cylinder means, a first flexible element extending between the king post assembly and an anchorage on the guide means, the first actuating part being in engagement with the first flexible element, a second flexible element extending between the king post assembly and an anchorage on the guide means, the second actuating part being in engagement with the second flexible element.

7. An excavator according to claim 6 wherein a second piston rod means extends from the cylinder means at the opposite end thereof to said first mentioned piston rod means, the second piston rod means being connected to an anchor means adapted to be fixed relative to the guide means at the opposite end thereof to the first mentioned anchor means.

8. An excavator according to claim 7 wherein the cylinder carries said first and second actuating parts adjacent opposite ends thereof.

9. An excavator according to claim 6 wherein the first flexible element has a further flexible element disposed in spaced parallel relationship therewith to provide a pair of first flexible elements and the ram means has a pair of first and second actuating members.

10. An excavator according to claim 6 wherein the anchor means, at least during operation of the excavator, is fixed relative to the guide means.

11. An excavator according to claim 6 wherein the ram means is provided to extend longitudinally of the guide means at a position between the upper and lower limits of the king post assembly and in a region disposed in front of a bracket part of the king post assembly which is slidably supported by the guide means.

* * * * *